US008157964B2

(12) United States Patent
Benjelloun Mlayah et al.

(10) Patent No.: US 8,157,964 B2
(45) Date of Patent: Apr. 17, 2012

(54) INSTALLATION FOR IMPLEMENTING A METHOD FOR PRODUCING PAPER PULP, LIGNINS AND SUGARS AND PRODUCTION METHOD USING SUCH AN INSTALLATION

(75) Inventors: Bouchra Benjelloun Mlayah, Pompertuzat (FR); Michel Delmas, Tolosane (FR); Gérard Avignon, Estillac (FR)

(73) Assignee: Compagnie Industrielle de la Matiere Vegetale, Levallois-Perret (FR)

( * ) Notice: Subject to any disclaimer, the term of this patent is extended or adjusted under 35 U.S.C. 154(b) by 812 days.

(21) Appl. No.: 11/913,420

(22) PCT Filed: Apr. 20, 2006

(86) PCT No.: PCT/EP2006/061715

§ 371 (c)(1), (2), (4) Date: Nov. 26, 2008

(87) PCT Pub. No.: WO2006/117295

PCT Pub. Date: Nov. 9, 2006

(65) Prior Publication Data

US 2009/0065158 A1 Mar. 12, 2009

(30) Foreign Application Priority Data

May 3, 2005 (FR) ..... 05 51158

(51) Int. Cl.
*D21C 7/00* (2006.01)
*D21C 7/12* (2006.01)

(52) U.S. Cl. ..... 162/237; 162/233; 162/243; 162/248

(58) Field of Classification Search ..... 162/60, 162/237, 233, 238, 243, 248, 251
See application file for complete search history.

(56) References Cited

U.S. PATENT DOCUMENTS 3,895,998 A * 7/1975 Haywood et al. ..... 162/100

(Continued)

FOREIGN PATENT DOCUMENTS

DE 195 16 151 11/1996

(Continued)

OTHER PUBLICATIONS

Grace editor, Pulp and Paper Manufacture:Alkaline Pulping, 1989, Joint Textbook Committee of the Paper Industry, vol. 5, Third Edition, p. 298.*

(Continued)

*Primary Examiner* — Matthew Daniels
*Assistant Examiner* — Anthony Calandra
(74) *Attorney, Agent, or Firm* — Young & Thompson

(57) ABSTRACT

The invention proposes an installation (10) in which the impregnation and fractionation of the raw material (MP) are conducted at atmospheric pressure, characterized in that it comprises means (18, 20) for transferring the raw material (MP) successively to a first treatment station (PT1) and a second treatment station (PT2), each comprising means (G1, G2) for temporarily combining, at the first station (PT1), the raw material (MP) with a quantity of a first mixture of organic acids and, at the second station (PT2), for temporarily combining the raw material (MP) with a quantity of a second mixture; and means, after impregnation, for at least partially recovering the quantity of second mixture after impregnation and for recycling at least a portion of the second recovered mixture to form at least partially said first impregnation mixture used at the first station (PT1).

18 Claims, 3 Drawing Sheets

U.S. PATENT DOCUMENTS

| | | | | |
|---|---|---|---|---|
| 4,154,644 | A * | 5/1979 | Ericsson | 162/60 |
| 4,608,122 | A * | 8/1986 | Klein et al. | 162/60 |
| 6,183,597 | B1 | 2/2001 | Siegle | |
| 7,402,224 | B1 * | 7/2008 | Avignon et al. | 162/76 |
| 2002/0079071 | A1 * | 6/2002 | Snekkenes et al. | 162/43 |
| 2007/0227681 | A1 * | 10/2007 | Jiang et al. | 162/237 |

FOREIGN PATENT DOCUMENTS

| | | |
|---|---|---|
| EP | 0 584 675 | 3/1994 |
| FR | 2 70 543 | 5/1999 |
| WO | WO 95/21960 | 8/1995 |
| WO | WO 00/68494 | 11/2000 |

OTHER PUBLICATIONS

Grace editor, Pulp and Paper Manufacture: Alkaline Pulping,1989 , Joint Textbook Committee of the Paper Industry, vol. 5 3rd edition, p. 297-300.*

SMOOK, Handbook for Pulp and Paper Technologists, 1992, Angus Wilde Publications, 2nd edition, Chapters 9 and 11.*

* cited by examiner

INSTALLATION FOR IMPLEMENTING A METHOD FOR PRODUCING PAPER PULP, LIGNINS AND SUGARS AND PRODUCTION METHOD USING SUCH AN INSTALLATION

TECHNICAL FIELD OF THE INVENTION

The present invention relates to an installation, or system, for implementing a method for producing paper pulp, lignins and sugars.

PRIOR ART

The invention relates, in particular, to an installation for implementing the method disclosed in the European Patent EP-B1-1.180.171.

SUMMARY OF THE INVENTION

The present invention aims, in particular, to propose an installation allowing optimal and economical implementation of this method, allowing selective extraction, in particular, of the products such as lignins and sugars.

To this end, the invention proposes an installation for implementing a method for producing paper pulp, lignins and sugars, in which:

- annual or perennial plants, used in their entirety or partially, which constitute the original lignocellulosic raw material (MP) are combined with a mixture of organic acids during an impregnation step;
- during a fractionation step, the solid fraction constituting the paper pulp is then separated from the organic phase containing, in particular, the original organic acids in solution, solubilized sugar monomers and polymers, and lignins derived from the original raw plant material;
- the impregnation and fractionation are conducted at atmospheric pressure;

characterized in that it comprises:

- means for transferring the raw material, from upstream to downstream, successively to a first treatment station and at least one second treatment station for the raw material and which are arranged consecutively from upstream to downstream and constituting a first pair of consecutive treatment stations, each treatment station comprising:
- means known as impregnation means for temporarily combining, at the first station, the raw material with a quantity of a first mixture of organic acids, known as the impregnation mixture, and, at the second station, for temporarily combining the raw material with a quantity of a second impregnation mixture of organic acids; and
- means, after impregnation, for at least partially recovering said quantity of second mixture after impregnation and for recycling at least a portion of the second recovered mixture to form at least partially said first impregnation mixture used at the first station.

According to further features of the invention:

- each station comprises means, after impregnation, for removing a portion of said quantity of second mixture to extract therefrom, in particular, solubilized sugar monomers and polymers, and lignins derived from the original raw plant material;
- the impregnation means for temporarily combining the raw material with a quantity of a mixture of organic acids comprise means for spraying the raw material such that the impregnation mixture passes through the raw material;

- the means for transferring the raw material from upstream to downstream comprise a conveyor, in particular of the belt type, on which the raw material is deposited upstream of the first station and is transported continuously;
- after having passed through the raw material, the impregnation mixture is discharged from the conveyor by gravity;
- each treatment station comprises means below the conveyor which collect the mixture of organic acids after having passed through the raw material;
- the collecting means comprise at least one trough which receives, by gravity, the mixture of organic acids after having passed through the raw material;
- each treatment station comprises at least one pump of which the inlet or suction is connected to the collecting means of the station and of which the outlet or discharge may be selectively connected to a recycling circuit and/or an extraction circuit;
- at each station, the installation comprises means for heating and for controlling the temperature of said quantity of impregnation mixture;
- the installation comprises means for continuously supplying said first station with raw material;
- the installation comprises means for pre-impregnation, or for prior impregnation, of the raw material with a mixture of organic acids, prior to the introduction of the raw material to the first station;
- the installation comprises means for supplying at least one downstream station with a mixture of organic acids for impregnation;
- the installation comprises means for supplying the station located the furthest downstream with a mixture of organic acids for impregnation;
- the installation comprises means for heating and for controlling the temperature of said mixture;
- the installation comprises a chamber, within which atmospheric pressure prevails and within which said means are arranged for transferring the raw material successively to each of the consecutive treatment stations, and which comprises an inlet for introducing the raw material into the chamber to supply said first station, an outlet for discharging the raw material after its transfer to the last station and within which said impregnation means and said recovery means are at least partially arranged;
- the installation comprises, successively from upstream to downstream, n treatment stations to which the raw material is successively transferred, and each pair of consecutive stations is designed or produced in the same manner as said first pair of consecutive stations.

BRIEF DESCRIPTION OF THE FIGURES

Further features and advantages of the invention will become evident from reading the detailed description which follows, for the understanding of which reference will be made to the accompanying drawings, in which.

DETAILED DESCRIPTION OF THE FIGURES

Figure 1:
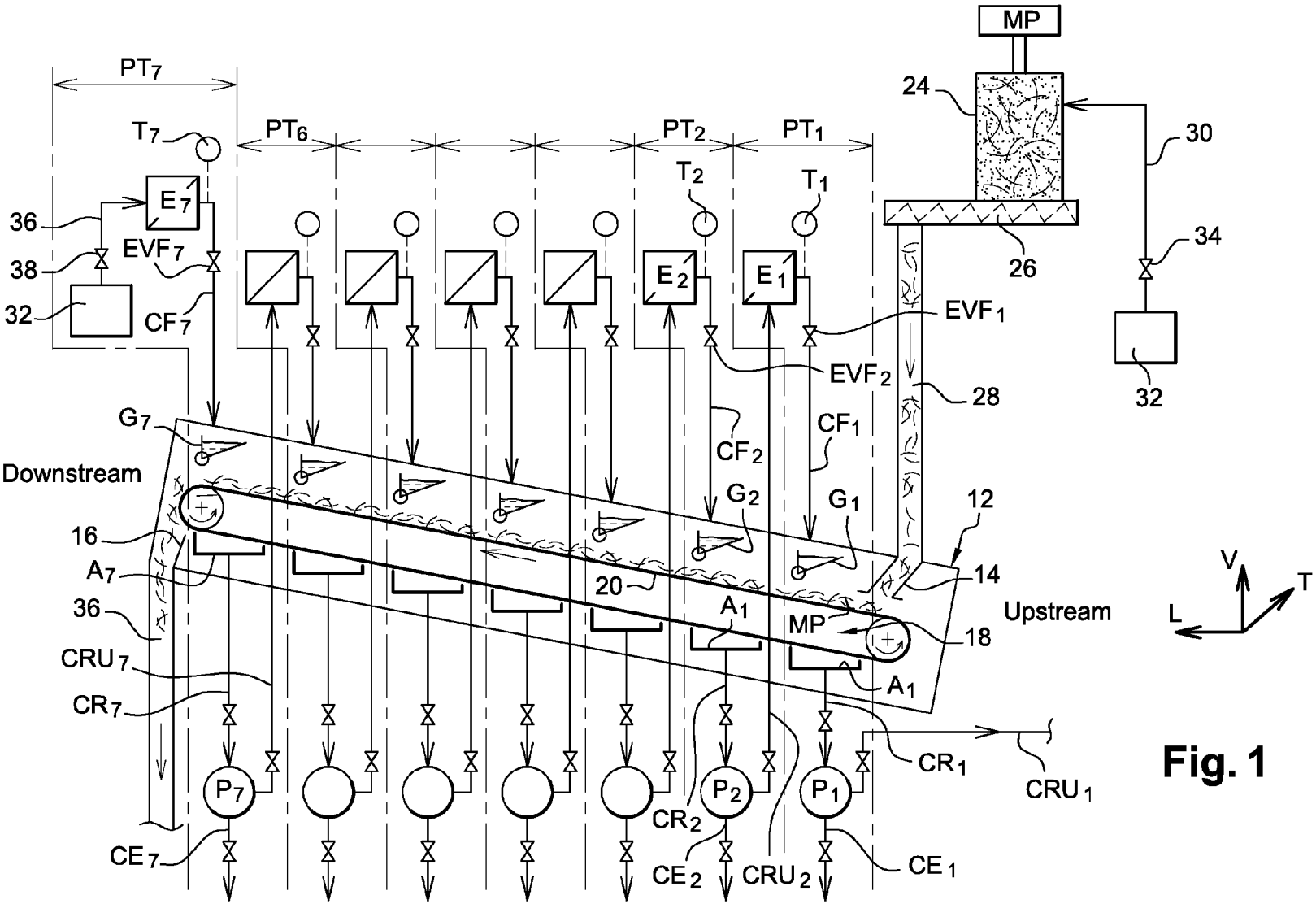
FIG. 1 is a schematic representation of an embodiment of an installation according to the teaching of the invention comprising, by way of non-limiting example, seven successive treatment stations for processing the raw material.
Figure 2:
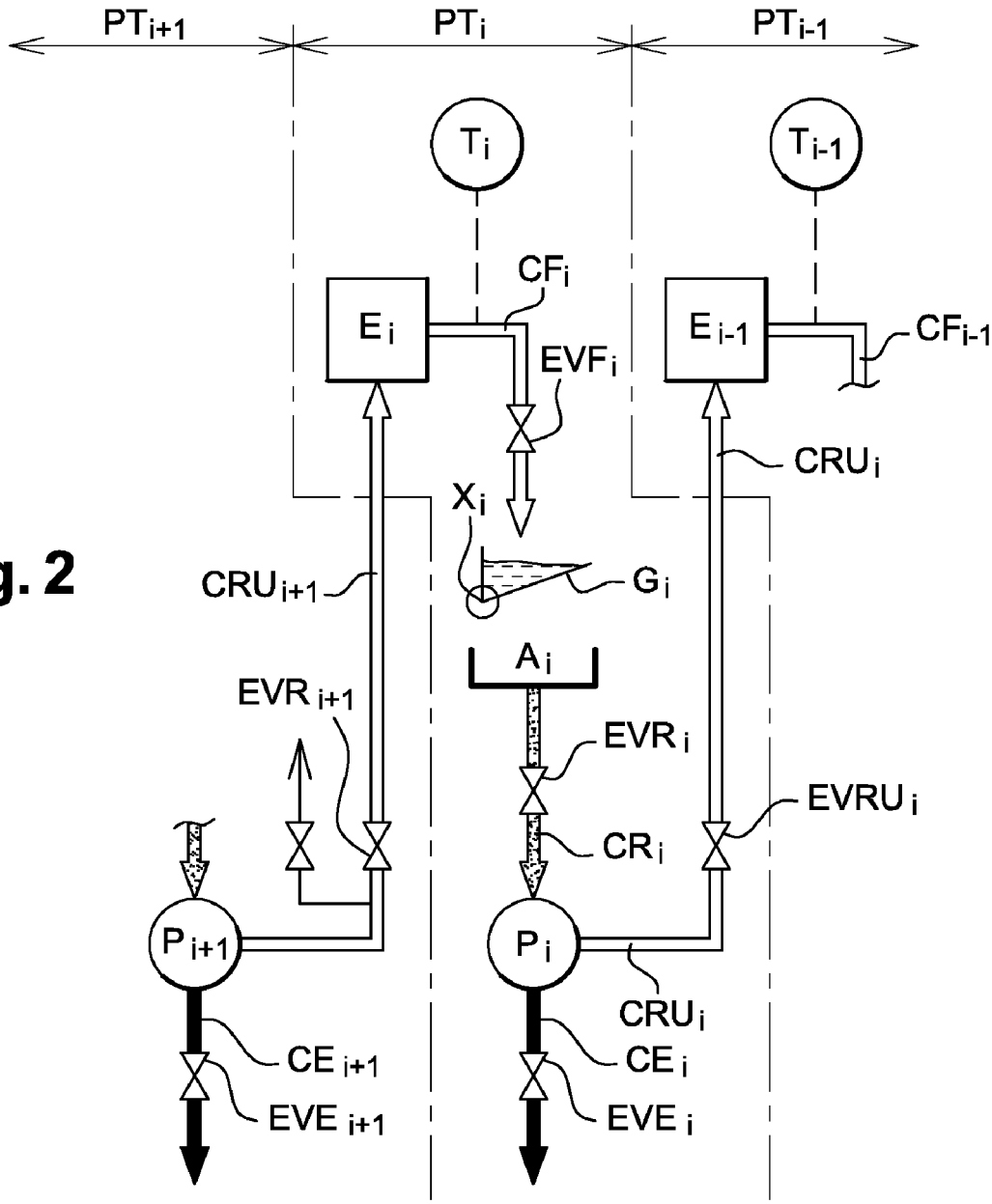
FIG. 2 is a larger scale diagram showing, in a simplified manner, the circulation of the various mixtures of organic acids between three consecutive treatment stations Ti−1, Ti and Ti+1.

In the description which follows, all identical, similar or analogous elements and components will be denoted by the same reference numerals.

The terms longitudinal, vertical and transverse will be used with reference to the trihedron L, V, T indicated in the figures.

The upstream-downstream orientation will also be used for the longitudinal circulation of the raw material from right to left, when viewing FIG. 1, along the axis L.

The installation 10 shown diagrammatically in FIG. 1 comprises a treatment chamber 12 which can be seen as the overall shape of a rectangular parallelepiped oriented longitudinally and substantially horizontally, for example with a slight inclination from downstream to upstream as shown in FIG. 1.

The treatment chamber 12 is impermeable to avoid any dissipation of acid vapour into the atmosphere and it comprises an upstream inlet 14 for supplying raw material and a downstream outlet 16 for discharging the treated raw material.

Atmospheric pressure prevails within the treatment chamber 12.

Within the chamber 12 a motorized conveyor 18 is arranged of which the belt 20, in the upper portion, travels from upstream to downstream from right to left and receives, in the vicinity of its upstream end, the raw material MP to be treated, entering the treatment chamber 12 via the inlet 14.

The belt 20 conveyor 18 therefore allows the raw material to be circulated from upstream to downstream within the chamber 12 at a constant speed or controlled by drive and control means, and by means, not shown, for controlling the transport speed of the raw material MP.

Figure 3:
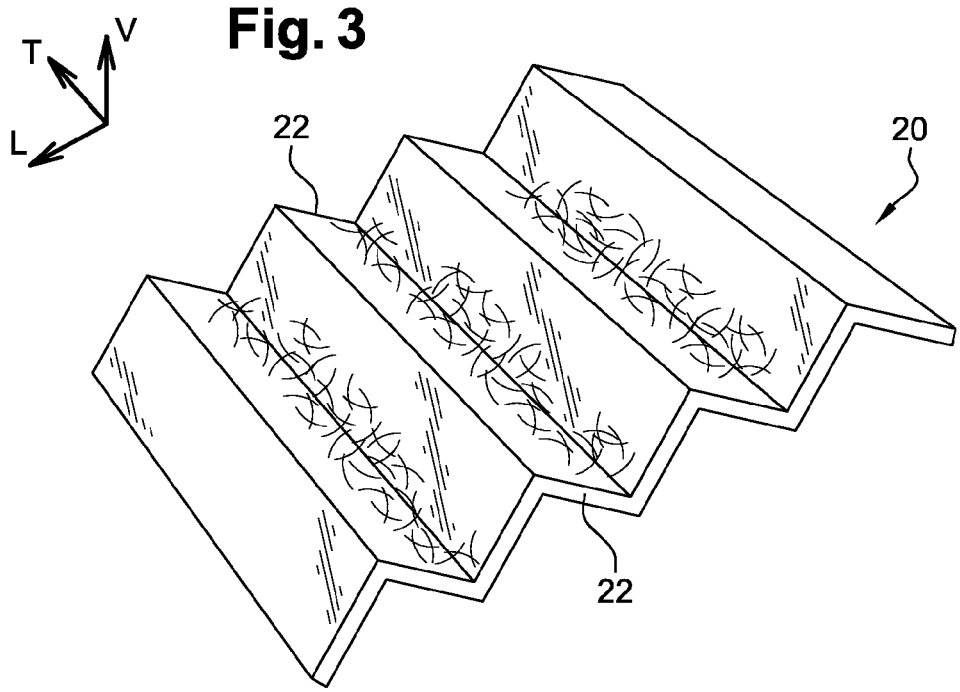
FIG. 3 is a schematic representation of a section of the belt of the belt conveyor.

As may be seen in the diagram of FIG. 3, the belt 20 extends over a specific transverse width and it consists, for example, of a corrugated metal sheet made from material resistant to acid mixtures.

The raw material MP is thus distributed in the most uniform manner possible, by means not shown, over the entire width of the belt 20 of the conveyor 18.

The belt 20 is arranged in the treatment chamber 12 so that the liquids that reach the upper face of the upper belt 20 can drain away, in this case laterally, on both sides of the longitudinal edges 22 of the belt and/or by way of a variant, not shown, through the belt 20" which is therefore perforated to this end.

The installation 10 comprises a hopper 24 for supplying the treatment chamber 12 with raw material MP.

The hopper 24 is connected to the inlet 14 by a screw 26 for propelling the raw material into a pipe 28 connected to the inlet 14.

As shown in FIG. 1, the hopper 24 may be connected via a duct 30 to a tank 32 containing a mixture of organic acids in order to carry out initial processing of the raw material MP in the hopper 24 by pre-impregnation of the raw material.

The supply flow rate from the hopper 24 of the mixture of acids for pre-impregnation may be controlled by a solenoid valve 34.

When the raw material MP leaves the upper belt 20 of the conveyor 18, it falls by gravity into the outlet 16 and is discharged via a discharge pipe 36.

The type of raw materials used, such as for example straw, as well as the composition of the mixtures of organic acids and their temperatures depend on the method of producing paper pulp, lignins and sugars implemented by means of the installation 10.

By way of example, reference may be made in particular to the contents of the European Patent EP-B1-1,180,171 to understand these physico-chemical parameters.

According to the teaching of the invention, apart from the treatment chamber 12 and its means for supplying raw material MP, the installation 10 comprises successively, from upstream to downstream, a series of n treatment stations PTi with i between 1 and n.

In the example shown in FIG. 1, the number of treatment stations is seven.

Thus, the first upstream treatment station is the station PT1 whilst the last downstream station is the station PT7.

All the components of a station PTi will be denoted by the same reference numerals indexed "I".

Each treatment station PTi is an 'autonomous' station and serves to ensure the combination or brief contact of the raw material MP with a mixture of organic acids in liquid form in order to ensure 'impregnation' of the raw material MP at each treatment station PTi.

In the figures, the various consecutive treatment stations are delimited by vertical dotted lines.

Each treatment station PTi, arranged vertically above the upper belt 20 conveying the raw material MP, comprises means for spraying the raw material with a mixture of organic acids by gravity.

By way of non-limiting example, in this case the spraying means of the raw material MP are constituted at each station by a bucket Gi which is illustrated in the figures in the resting and filling position and which is capable of swinging about its lower horizontal axis Xi to discharge its contents vertically, and substantially over the entire transverse length of the belt 20, onto the raw material MP located on the upper belt 20 substantially to the right of the bucket Gi.

By way of a variant, not shown, the means for spraying the raw material at each station may be constituted by one or more booms for spraying or sprinkling the raw material by gravity, so as to guarantee the most uniform distribution possible of the mixture of organic acids.

Each station PTi also comprises means for recovering the mixture of organic acids for impregnation of the raw material MP, after this mixture has passed through the raw material MP, and then drained away laterally on both sides of the belt conveyor 20 and/or passed through the belt if said belt is perforated or apertured to this end with perforations of a sufficiently small size so as to allow only the passage of the liquids to be recovered.

These means for collecting the mixture of organic acids after having passed through the raw material MP are, in this case, constituted at each station by a collection trough Ai which extends transversely over the entire width of the treatment chamber 12 and substantially longitudinally over the entire length of a treatment station PTi.

In the sense of the invention, the mixture of organic acids which fills the bucket Gi at each station is known as the "fresh" mixture of organic acids and which, at the relevant station, is placed temporarily in contact with the raw material MP to impregnate said raw material by passing therethrough.

A temporary "immersion" of the raw material MP is therefore carried out at the station PTi by passing a fresh mixture of organic acids through the raw material MP by gravity.

It is also noteworthy, according to the principle of the invention, that the raw material is never received in a bath of the mixture of organic acids but said mixture of organic acids simply impregnates and briefly passes through the raw material.

Each bucket Gi is supplied with fresh mixture by a supply pipe CFi in which a solenoid valve is interposed to control the flow rate of fresh mixture EVFi.

A heat exchanger Ei, or any other equivalent heating means, provided with means Ti for controlling the temperature, allows the temperature of the fresh mixture supplying the bucket Gi to be accurately determined.

After its recovery in the collection trough Ai, the mixture of organic acids is suctioned, in this case by a pump Pi, of which the suction inlet is connected to the trough Ai via a recovery pipe CRi with a solenoid valve EVRi interposed for controlling the flow rate in the pipe CRi.

As is shown diagrammatically in the figures, the delivery outlet of the pump Pi is firstly connected to an extraction pipe CEi in which a solenoid valve EVEi is interposed to control the extraction flow rate.

The delivery outlet of the pump Pi is also connected to a pipe CRUi for recycling at least a portion of the recovered mixture of organic acids, with a solenoid valve EVRUi interposed in the pipe CRUi for controlling the flow rate.

All the solenoid valves of the installation are connected to a central control unit, not shown, as are the means for heating Ei and thermal control Ti.

The recycling pipe CRUi of a treatment station PTi is connected, in this case via the heat exchanger Ei-1, to the pipe CFi-1 which supplies the bucket Gi-1 of the treatment station PTi-1 located in this case immediately upstream of the station PTi.

Thus, according to the teaching of the invention, at the "second" treatment station Pi, the raw material MP is impregnated with a "second" fresh mixture of organic acids, then a portion of the second mixture is recovered after impregnation of the material MP so that said second mixture is recycled to form at least partially the "first" fresh acid mixture intended for impregnating the raw material MP, located immediately upstream of the station PTi, at the 'first' treatment station PTi-1.

Naturally, at the last downstream station PTn, i.e. in this case at the station PT7, means E7, T7 and EVF7 are provided for supplying the bucket G7 with a fresh acid mixture.

To this end, the heat exchanger E7 itself is, for example, also connected to the tank of the mixture of organic acids 32 via a pipe 36 with a solenoid valve 38 for controlling the flow rate.

The original mixture of organic acids contained in the tank 32 which supplies the last downstream station PTn is thus at least partially recycled from station to station as far as the first station PT1.

At the first upstream station PT1, the pipe CRU1 is, in this case, a discharge pipe for the mixture of organic acids suctioned by the pump P1 and which is not recycled.

Without departing from the scope of the invention, it is conceivable that each station PTi, i.e. each bucket Gi, apart from the mixture of organic acids recovered at the station located immediately downstream, be also partially supplied with a mixture of organic acids originating from another source, and, for example, from the tank 32 of the original mixture of organic acids.

The extraction pipe CE1 of each treatment station PTi allows a portion of the mixture of organic acids, having passed through the raw material MP at this station, to be removed to extract, in particular, solubilized sugar monomers and polymers, and lignins derived from the original plant material MP.

The possibility of removing mixture for the purpose of extraction(s) at each treatment station PTi provides many advantages.

It allows, in particular, lignins of specific and known molecular weights to be extracted, these lignins being able to be characterized, in the known manner, in particular by mass spectrometry.

The same applies to sugars and, in particular, hydrolysed hemicelluloses.

It is noteworthy that recovering and recycling the mixture of organic acids from station to station progressively changes said mixture into lignins and sugars, whilst the alteration of its concentration of organic acids is observed.

Being able to carry out an extraction at each station, and in particular at the first station PTi, also allows the water content to be readjusted, in particular to ascertain the moisture or water content of the raw material MP which depends on its particular type and, for example, also on its storage conditions prior to being treated in the installation.

The invention is not limited to the embodiment which has been disclosed above.

The belt conveyor may be replaced by any similar device, such as for example a screw conveyor.

All the treatment stations may be divided into successive groups in separate chambers with the transfer of the raw material and mixtures of acids from one chamber to the next.

The collection troughs have been shown in the figures in the form of discrete components, i.e. each station PTi comprising its trough Ai.

Figure 4:
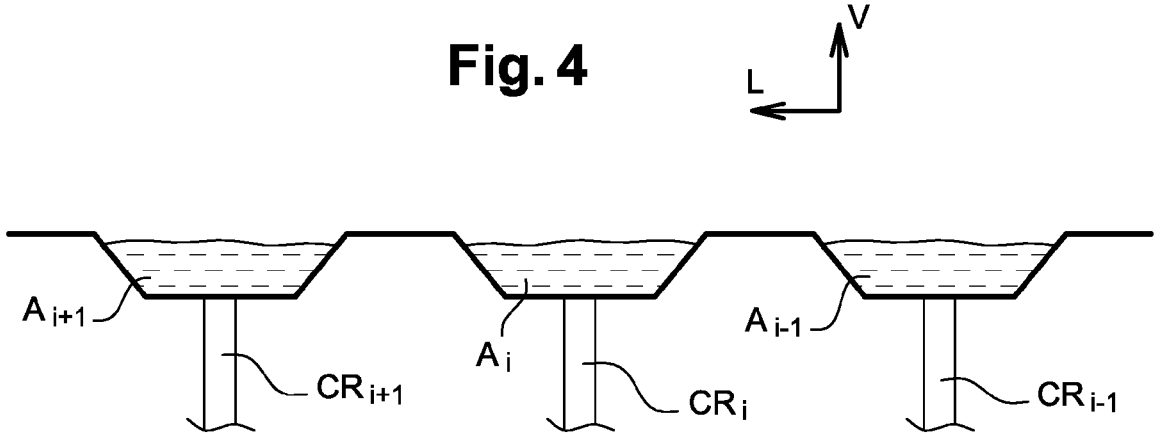
FIG. 4 is a schematic representation showing a particular arrangement of the collection troughs.

As has been shown diagrammatically in FIG. 4, the troughs Ai may belong to an assembly allowing all the mixtures that have passed through the raw material MP and have been discharged from the belt conveyor 18 to be collected by a collection trough, substantially to the right of each treatment station PTi.

The dimensions in the longitudinal direction L of each collection trough Ai and between the consecutive zones allow, in particular, the molecular weights or groups of molecular weights of the lignins extracted at each station to be "controlled".

The invention also relates to a method for producing paper pulp by means of an installation according to the invention which is characterized in that a portion of said quantity of second mixture is removed to extract therefrom sugar monomers and polymers of specific molecular weights. The invention also relates to sugar monomers and polymers of specific molecular weights obtained according to this method.

The invention claimed is:

1. An installation for implementing a method for producing paper pulp, lignins and sugars in which:

annual or perennial plants, used in their entirety or partially, which constitute an original lignocellulosic raw material are combined with a mixture of organic acids during an impregnation step;

during a fractionation step, a solid fraction constituting the paper pulp is then separated from an organic phase containing, the original organic acids in solution, solubilized sugar monomers and polymers, and lignins derived from the original lignocellulosic raw material;

the impregnation and fractionation are conducted at atmospheric pressure; the installation comprising:

means for transferring the raw material comprising a conveyor, from upstream to downstream, successively to a first treatment station and at least one second treatment station for the raw material and which are arranged consecutively from upstream to downstream and constituting a first pair of consecutive treatment stations, each treatment station comprising:

means for temporarily combining, at the first station, the raw material with a quantity of a first mixture of organic acids, known as the impregnation mixture, and, at the second station, for temporarily combining the raw material with a quantity of a second impregnation mixture of organic acids;

means, after impregnation, for at least partially recovering said quantity of second mixture after impregnation and for recycling at least a portion of the second recovered mixture to form at least partially said first impregnation mixture used at the first station, comprising a pump, a piping and a control valve downstream of said pump; and means, after impregnation, for removing a portion of said quantity of second mixture to extract therefrom solubilized sugar monomers, polymers and lignins derived from the original raw plant material, comprising the pump, a second piping and a second control valve downstream of said pump.

2. The installation according to claim 1, wherein said means for temporarily combining the raw material with a quantity of a mixture of organic acids comprise means for spraying the raw material such that the impregnation mixture passes through the raw material.

3. The installation according to claim 2, wherein after having passed through the raw material, said impregnation mixture is discharged from the conveyor by gravity.

4. The installation according to claim 2, wherein each station comprises means below the conveyor for collecting the mixture of organic acids after having passed through the raw material.

5. The installation according to claim 4, wherein the means for collecting comprise at least one trough which receives, by gravity, the mixture of organic acids after having passed through the raw material.

6. The installation according to claim 1, wherein at each station, the installation further comprises means for heating and for controlling the temperature of said quantity of impregnation mixture.

7. The installation according to claim 1, wherein the installation further comprises means for continuously supplying said first station with raw material.

8. The installation according to claim 1, wherein the installation further comprises means for pre-impregnation, or for prior impregnation, of the raw material with a mixture of organic acids, prior to the introduction of the raw material to the first station.

9. The installation according to claim 1, wherein the installation further comprises means for supplying at least one downstream station with a mixture of organic acids for impregnation.

10. The installation according to claim 9, wherein the installation further comprises means for supplying the station located the furthest downstream with a mixture of organic acids for impregnation.

11. The installation according to claim 9, wherein the installation further comprises means for heating and for controlling the temperature of said mixture.

12. The installation according to claim 1, wherein the installation further comprises a chamber, within which atmospheric pressure prevails and within which said means for transferring the raw material are arranged for transferring the raw material successively to each of the consecutive treatment stations, and which comprises an inlet for introducing the raw material into the chamber to supply said first station, an outlet for discharging the raw material after its transfer to the last station and within which said means for temporarily combining and a means for recovery are at least partially arranged.

13. The installation according to claim 1, wherein the installation further comprises, successively from upstream to downstream, n treatment stations to which the raw material is successively transferred, and in that each pair of consecutive stations is produced in the same manner as said first pair of consecutive stations.

14. The installation according to claim 1, wherein said means for temporarily combining the raw material with a quantity of a mixture of organic acids comprise means for spraying the raw material such that the impregnation mixture passes through the raw material.

15. The installation according to claim 3, wherein each station comprises means below the conveyor for collecting the mixture of organic acids after having passed through the raw material.

16. The installation according to claim 1, wherein said means for transferring the raw material from upstream to downstream comprise a belt conveyor on which the raw material is deposited upstream of the first station and is transported continuously.

17. An installation for producing paper pulp, lignins and sugars at atmospheric pressure, comprising:

a conveyor and a belt configured to transfer lignocellulosic raw material from upstream to downstream;

a first treatment station; and at least one second treatment station, the first and second treatments stations being configured to receive the raw material and which are arranged consecutively from upstream to downstream and constituting a first pair of consecutive treatment stations, each treatment station comprising:

a bucket or a spraying device configured to temporarily combine, at the first station, the raw material with a quantity of a first impregnation mixture of organic acids, and, at the second station, for temporarily combining the raw material with a quantity of a second impregnation mixture of organic acids;

a collection trough configured for, after impregnation and fractionation, to at least partially recover said quantity of the second mixture after impregnation and fractionation; and a pump, a piping and a control valve downstream of said pump for recycling at least a portion of the second recovered mixture to form at least partially said first impregnation mixture utilized at the first station, the fractionation having produced a solid fraction constituting the paper pulp and an organic phase containing the original organic acids in solution, solubilized sugar monomers, polymers, and lignins derived from the original lignocellulosic raw material; and a second piping and a second control valve downstream of said pump configured for, after impregnation and fractionation, for removing a portion of said quantity of second mixture to extract therefrom solubilized sugar monomers, polymers and lignins derived from the original lignocellulosic raw material.

18. The installation according to claim 17, wherein each station further comprises a heater and a thermal control configured for controlling the temperature of said quantity of impregnation mixture.

* * * * *